United States Patent [19]

Altherr et al.

[11] 4,456,133

[45] Jun. 26, 1984

[54] SLACKLESS RAILWAY COUPLER CONNECTION

[75] Inventors: Russell G. Altherr, Munster, Ind.; John W. Kaim, Chicago, Ill.

[73] Assignee: AMSTED Industries Incorporated, Chicago, Ill.

[21] Appl. No.: 361,399

[22] Filed: Mar. 24, 1982

[51] Int. Cl.[3] ..... B61G 1/32; B61G 5/00; B61G 7/00; B61G 9/20

[52] U.S. Cl. ..... 213/62 R; 213/61; 213/69; 213/75 R

[58] Field of Search ..... 105/4 R; 213/50, 50.5, 213/60, 62 A, 64, 69, 72, 75 R, 62 R, 61

[56] References Cited

U.S. PATENT DOCUMENTS

| | | | |
|---|---|---|---|
| Re. 29,011 | 10/1976 | Altherr | 213/64 |
| 1,443,716 | 1/1923 | Pletcher | 213/62 R X |
| 1,925,319 | 9/1933 | Goodall | 213/62 A X |
| 2,055,472 | 9/1936 | Barrows | 213/69 |
| 2,282,146 | 5/1942 | Mealing et al. | 213/62 A X |
| 2,327,240 | 8/1943 | Barrows et al. | 213/62 A X |
| 3,220,563 | 11/1965 | Baker | 213/62 R |
| 3,716,146 | 2/1973 | Altherr | 213/75 R |
| 3,760,954 | 9/1973 | Hershey et al. | 213/69 |
| 4,258,628 | 3/1981 | Altherr | 105/4 R |
| 4,336,758 | 6/1982 | Radwill | 105/4 R |

*Primary Examiner*—Howard Beltran

*Attorney, Agent, or Firm*—Edward J. Brosius; Fred P. Kostka

[57] ABSTRACT

A railway coupler connection is provided for use in a coupler shank-yoke or a drawbar-yoke configuration. Self adjusting slack reduction is provided by a wedge shaped shim or an angled follower block. Vertical and horizontal angling of the coupler connection is provided for by the curved shape of the contacting surfaces of the butt portion of the shank or drawbar and the follower block and the yoke.

2 Claims, 6 Drawing Figures

SLACKLESS RAILWAY COUPLER CONNECTION

BACKGROUND OF THE INVENTION

The present invention relates generally to railway coupler connections, and more particularly to slack adjusted drawbar and coupler connections.

With the increased loads carried by today's trains, it is important to maintain close butted relationships between draft components to lessen impact forces under buff conditions and sudden pulling forces under draft conditions. Since most drawbar and coupler parts are cast with little or no finish machining to provide dimensional control, it is desirable to provide a coupling device which is self adjusting under various wear conditions to lessen the slack in such connections.

Known slack adjusters have comprised various sized shims which were inserted and replaced in couplers under various wear conditions. Self adjusting wedge shaped shims for articulated couplers, such as shown in U.S. Pat. No. 3,716,146, are also known.

It is also desirable to provide for the vertical and horizontal movement of such couplers as normally occurs when a train is negotiating a curve or a gradient. If equipped with a key drawbar assembly, the possible bending of the key or pin or even the bending or cracking of the drawbar or coupler shank must be considered due to the vertical motion of the drawbar or coupler shank. Such a situation is discussed in U.S. Pat. No. Re. 29,011, wherein a diverging coupler shank keyslot is shown to accommodate the vertical movements of the coupler shank.

SUMMARY OF THE INVENTION

The present invention provides a railway coupler connection adaptable for use with a coupler shank configuration or a drawbar configuration. Self adjusting slack reduction is provided by a wedge shaped shim and an angled surface on at least one of the adjacent members. In a horizontal keyhole arrangement, the vertical angling of the coupler shank or drawbar is provided for by a divergent keyhole in the coupler shank or drawbar. Horizontal angling is provided by a key bearing block with a horizontally curved surface. The vertical and horizontal angling of the coupler connection is also provided for by the curved shape of the contacting surfaces between the butt portion of the shank or drawbar and the follower block and the yoke.

In particular, the present invention provides a railway drawbar coupler arrangement comprising a drawbar having an elongated shank portion and a curved butt end, said drawbar further having a slot extending horizontally through the shank portion, said slot having an upper surface and lower surface each having a portion of which diverges away from the longitudinal centerline of the drawbar, a follower block having a curved surface abutting the curved butt end of the drawbar and a generally flat surface, a wedge shaped shim, and a pocket having a generally flat interior rear surface, the flat surface of the follower block and of the pocket diverging upwardly, said wedge shaped shim fitting between the flat interior rear surface of the pocket and the flat surface of the follower block.

The present invention also provides a railway coupler arrangement comprising an elongated shank having a curved butt end section, a yoke having an internal curved bottom section and an internal generally flat rear wall, a follower block having a curved front wall and a generally flat rear wall, the curved butt end section of the shank abutting the curved bottom section of the yoke and the curved front wall of the follower block, the flat wall of the follower and the internal flat rear wall of the yoke diverging upwardly and a wedge shaped shim fitting between the flat rear wall of the yoke and the flat rear wall of the follower block.

The present invention further provides a railway drawbar coupler arrangement comprising a drawbar having an elongated shank portion and a curved butt end, said curved butt end having a generally flat diverging rear wall, a yoke having a curved internal rear section and a curved internal bottom section, a follower block having a curved rear wall and generally flat diverging front wall, and a wedge shaped shim, the curved butt end of the drawbar abutting against the curved internal bottom section of the yoke, the curved rear wall of the follower block abutting against the curved internal rear section of the yoke, and the wedge shaped shim fitting between the front wall of the follower block and the rear wall of the butt end of the drawbar.

DESCRIPTION OF THE PREFERRED EMBODIMENT

Figure 1:
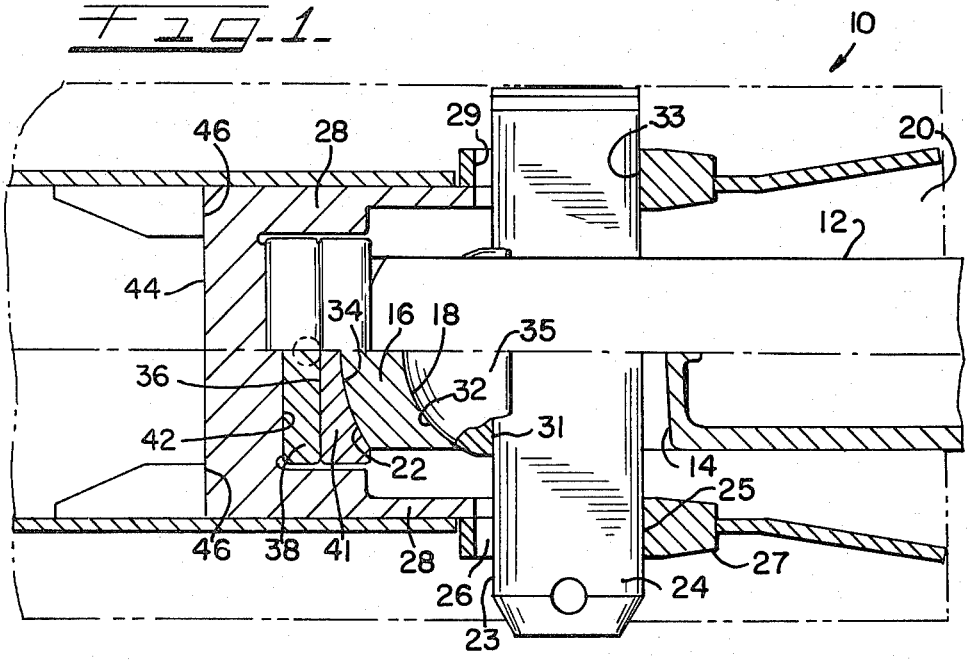
FIG. 1 is a top view, in partial cross section, of a horizontal key drawbar coupler arrangement made in accordance with the present invention.
Figure 2:
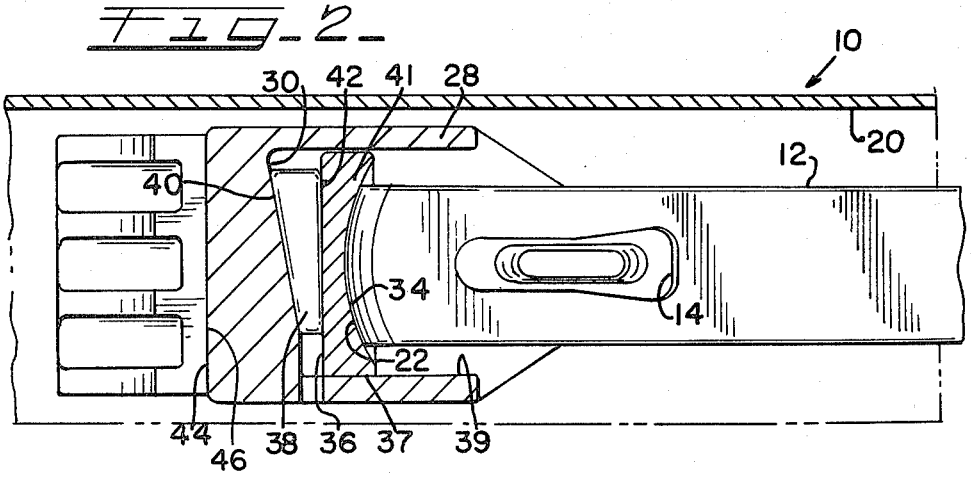
FIG. 2 is a side view, in cross section, of the horizontal key drawbar coupler arrangement of FIG. 1.

As shown in FIGS. 1 and 2, a horizontal key drawbar coupler arrangement is shown generally at 10. Drawbar 12 extends along its longitudinal axis into car center sill 20. Alternatively, drawbar 12 could comprise a coupler shank. Drawbar 12 has an opening or keyslot 14 extending through and normal to its longitudinal axis, opening 14 having a concave curved surface 18. The longitudinal upper and lower edges of keyslot 14 diverge from the longitudinal axis of drawbar 12 at angles of about 7° for at least part of the length of keyslot 14. Drawbar 12 ends in curved butt section 16, having a convex curved surface 22. Pin or key 24 is of an elongated bar shape having cylindrical edge surface 25 in mating engagement with concave surface 33 of opening 26 in side casting 27, and extends through keyslot 14 and opening 26 in side casting 27. Key bearing block 35 has a concave cylindrical front surface 31 that abuts rear convex surface 23 of key 24 and has a convex curved surface 32 which abuts curved surface 18 of drawbar 12.

Pocket 28 fits within car center sill 20 at a predetermined longitudinal spacing from opening 26 of side casting 27. Pocket 28 has a generally flat interior rear wall 30 and a bottom interior surface 39. Follower block 41 is located within pocket 28. Follower block 41 has a concave front surface 34 that abuts convex curved surface 22 of drawbar butt section 16. Follower block 41 also has a flat rear surface 36 and a bottom surface 37 which rests on bottom surface 39 of pocket 28 to keep concave front surface 34 of follower block 41 symmetrical with keyslot 14 of drawbar 12. Wedge shaped shim 38 has a generally flat front surface 42 that abuts generally flat rear surface 36 of follower block 41 and a generally flat rear surface 40 that abuts interior rear wall 30 of pocket 28. Flat shim surfaces 40 and 42 diverge vertically. The angle of incline of either or both interior rear wall 30 of pocket 28 and inclined rear surface 40 of follower block 41 is 10° or less from the vertical. End 44 of pocket 28 bears against shoulders 46 of car sill 20.

By the gravity induced downward force of shim 38, an essentially slackless drawbar coupler arrangement is provided through the abutted connection of car sill shoulder 46, pocket 28, shim 38, follower block 41 and the drawbar butt section 16, key bearing block 35, key 24 and side casting 27 as described above. This arrangement remains so without further adjustment, through a range of wear conditions on the abutting surfaces. Further, due to the nature of the abutting surfaces, easier vertical and horizontal movement of the coupler shank or drawbar is permitted with less chance of hang up due to jamming.

Figure 3:
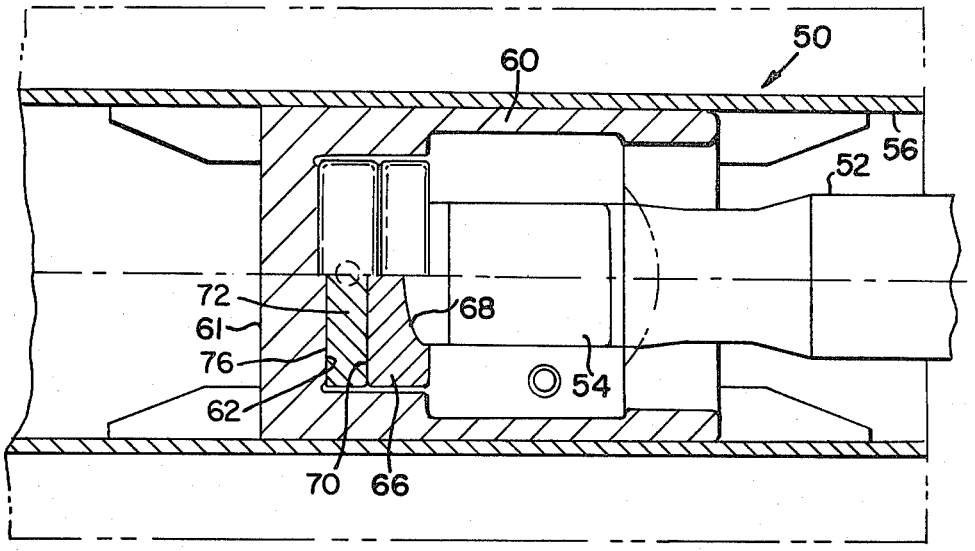
FIG. 3 is a top view, in partial cross section, of a pinless drawbar coupler arrangement made in accordance with the present invention.
Figure 4:
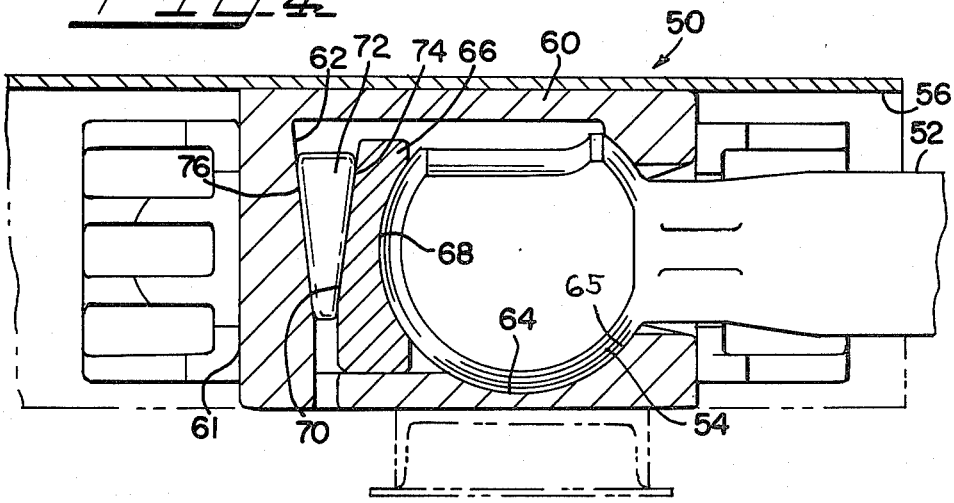
FIG. 4 is a side view, in cross section, of the pinless drawbar coupler arrangement of FIG. 3.

As shown in FIGS. 3 and 4, a second embodiment of the present invention as a pinless drawbar coupler arrangement is shown generally at 50. Drawbar 52 extends along its longitudinal axis into car sill 56. Alternatively, drawbar 52 could comprise a coupler shank. Drawbar 52 ends in a curved or spherical butt section 54.

Yoke 60 has a generally flat internal rear surface 62 which angles from the vertical at about 10°. Yoke 60 also has a curved internal bottom surface 64 on which spherical or curved butt section 54 rests.

Follower block 66 is located within yoke 60. Follower block 66 has a concave curved front surface 68, and a generally flat rear surface 70. Follower block curved front surface 68 abuts curved butt section 54 of drawbar 52. A wedge shaped shim 72 has a generally flat front surface 74 that abuts flat rear surface 70 of the follower block 66 a generally flat rear surface 76 that abuts flat internal rear surface 62 of yoke 60. Surfaces 74 and 76 of shim 72 diverge vertically and either one or both surfaces 62 and 70 are inclined at an angle of about 10° from the vertical. End 61 of yoke 60 may or may not abut a draft gear energy absorbing device, as desired.

By the gravity induced downward force of shim 72, an essentially slackless drawbar coupler arrangement is provided through the abutted connection of the yoke rear surface 62, shim 72, follower block 66, internal front surface 65 of yoke 60 and the drawbar as described above. This arrangement remains so without further adjustment, through a range of wear conditions on the abutting surfaces. Further, due to the curvature of the abutting surfaces, easier vertical and horizontal movement of the coupler shank or drawbar is permitted with less chance of hang up due to jamming.

Figure 5:
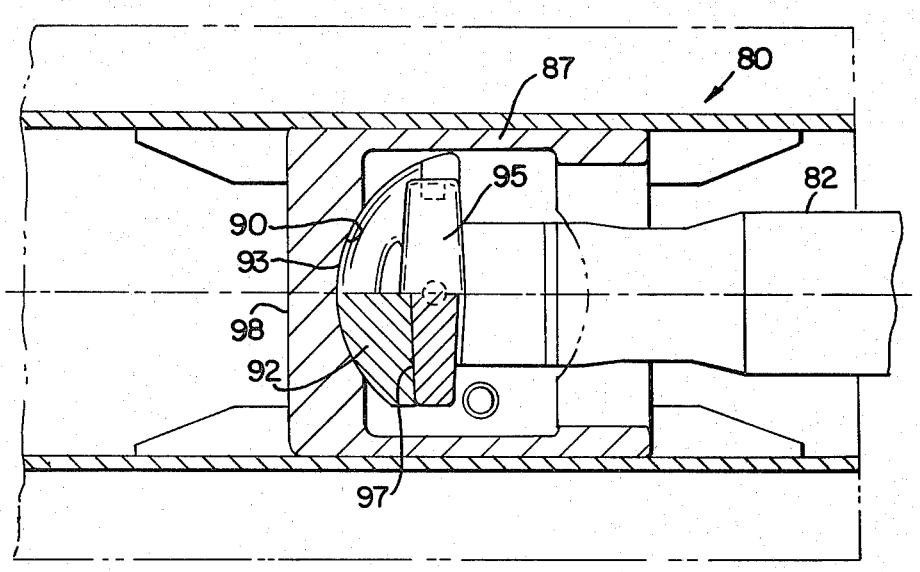
FIG. 5 is a top view, in partial cross section, of a second pinless drawbar coupler arrangement made in accordance with the present invention.
Figure 6:
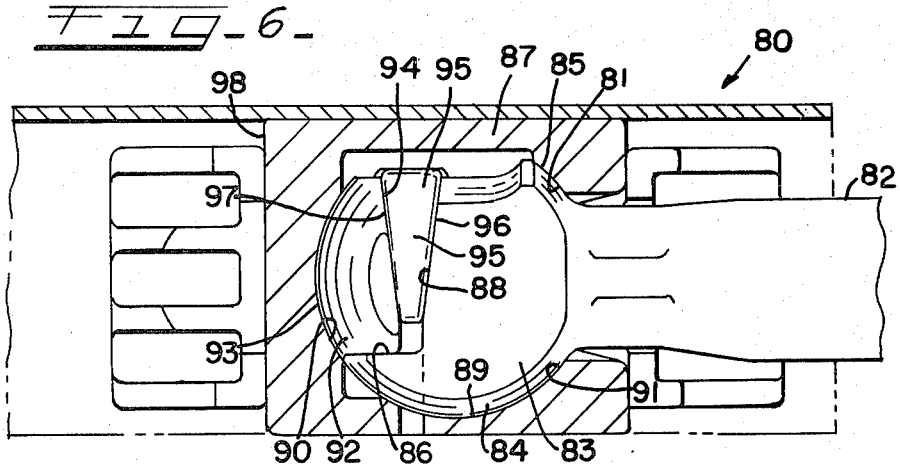
FIG. 6 is a side view, in cross section, of the pinless drawbar coupler arrangement of FIG. 5.

As shown in FIGS. 5 and 6, another embodiment of the present invention is shown as a pinless drawbar coupler connection. Shown generally at 80, the pinless drawbar coupler connection includes a drawbar 82, which alternatively could comprise a coupler shank. Drawbar 82 ends in a butt 83, which comprises curved or spherical upper section 85 and curved or spherical lower section 84, extending into shelf surface 86 and into generally flat rearward facing surface 88. Yoke 87 has a curved interior bottom surface 89 on which curved lower section 84 of drawbar butt 83 rests. Bottom surface 89 extends onto the lower forward section 91 of yoke 87 and cooperates with yoke upper forward wall surface 81 to abut drawbar sections 84 and 85.

Follower block 92 has a curved rear surface 93 which abuts a curved interior rear surface 90 of yoke 87. Wedge shaped shim 95 has a multiple flat rear surface 97 that abuts matching multiple flat front surfaces 94 of follower block 92 and a multiple flat front surface 96 that abuts matching multiple flat surfaces 88 of drawbar butt 83. Surfaces 96 and 97 diverge upwardly and either or both of these surfaces angle at about 10° from the vertical. End 98 of yoke 87 may or may not abut a draft gear energy absorbing device, as desired.

By the gravity induced downward force of shim 95, an essentially slackless drawbar coupler arrangement is provided through the abutted connection of yoke surfaces 81, 91 and 90, shim 95, follower block 92 and the drawbar butt 83 as described above. This arrangement remains so, without further adjustment, through a range of wear conditions on the abutting surfaces. Further, due to the curvature of the abutting surfaces, easier vertical and horizontal movement of the coupler shank or drawbar is permitted with less chance of hang up due to jamming.

What is claimed is:

1. A railway drawbar coupler arrangement comprising a drawbar, said drawbar comprising an elongated shank portion and a vertically and horizontally convex butt surface at an end thereof, said drawbar further having near one end thereof a slot extending horizontally through the shank portion, said slot having an upper surface and lower surface each having a forward portion of which diverges away from the longitudinal centerline of the drawbar, a bar shaped key extending horizontally through said slot, and a bearing block between said key and the rear inner concave surface of the drawbar slot, a follower block having a vertically and horizontally concave front surface abutting the convex butt end of the drawbar and a generally flat rear surface, a wedge shaped shim, and a generally rectangular pocket having two side walls, a bottom wall, a top wall and a generally flat interior rear surface, the flat surfaces of the follower block and of the pocket diverging upwardly, said follower block having a bottom surface resting on the bottom wall of said pocket to keep the concave front surface of the follower block vertically symmetrical with the drawbar slot, said wedge shaped shim fitting between the flat interior rear surface of the pocket and the flat rear surface of the follower block such that by the gravity induced downward force of said shim, said drawbar butt end maintains butted contact with the front surface of the follower block, and the bearing block maintains contact with the inner concave surface of the drawbar slot and the key.

2. A railway drawbar coupler arrangement comprising a drawbar having an elongated shank portion and a convex butt end, said convex butt end having a generally flat, forwardly diverging rear wall, a yoke having a concave internal rear section, concave lower and upper forward sections and a concave internal bottom section, a follower block having a convex rear wall and a generally flat diverging front wall, and a wedge shaped shim, the convex butt end of the drawbar abutting against the concave internal bottom section of the yoke, the convex rear wall of the follower block abutting against the concave internal rear section of the yoke, and the wedge shaped shim fitting between the front wall of the follower block and the rear wall of the butt end of the drawbar such that by the gravity induced downward force of said shim, said drawbar maintains butted contact with the forward section of said yoke.

* * * * *